United States Patent [19]

Miller et al.

[11] 4,056,237

[45] Nov. 1, 1977

[54] SPACER FOR SPOOL TUBES

[75] Inventors: Harry B. Miller, Charlotte, N.C.; Günter Jährig, Eggenstein-Leopoldshafen, Germany

[73] Assignee: Industrie-Werke Karlsruhe Augsburg Aktiengesellschaft, Germany

[21] Appl. No.: 729,817

[22] Filed: Oct. 5, 1976

[30] Foreign Application Priority Data

Oct. 8, 1975 Germany ..... 7531948

[51] Int. Cl.[2] ..... B65H 54/00

[52] U.S. Cl. ..... 242/18 PW; 242/125.1

[58] Field of Search ..... 242/18 PW, 18 A, 46.2, 242/130, 125, 125.1, 125.2, 129.7, 129.71

[56] References Cited

U.S. PATENT DOCUMENTS

| | | | |
|---|---|---|---|
| 2,815,905 | 12/1957 | Birchler et al. | 242/46.2 |
| 2,931,587 | 4/1960 | Pistor | 242/18 PW |
| 3,814,339 | 6/1974 | Hudson | 242/18 PW |

*Primary Examiner*—Leonard D. Christian
*Attorney, Agent, or Firm*—McGlew and Tuttle

[57] ABSTRACT

A device for the axial spacing of spool tubes along a common spool carrier, comprising a rotatable cylindrical spool carrier which has a periphery with a recess therein which accommodates a device which permits passage of a first spool tube over the carrier to a position at which the first spool tube abuts against a stop. The device thereafter projects outwardly from the periphery of the spool carrier behind the first spool tube so as to prevent the second spool tube placed on the carrier from moving further toward the first spool tube and thereby maintains a spacing between the two spool tubes. The spool carrier also carries a recess in the periphery thereof at the location between the two spool tubes which comprises a means for catching the thread which is to be wound.

6 Claims, 1 Drawing Figure

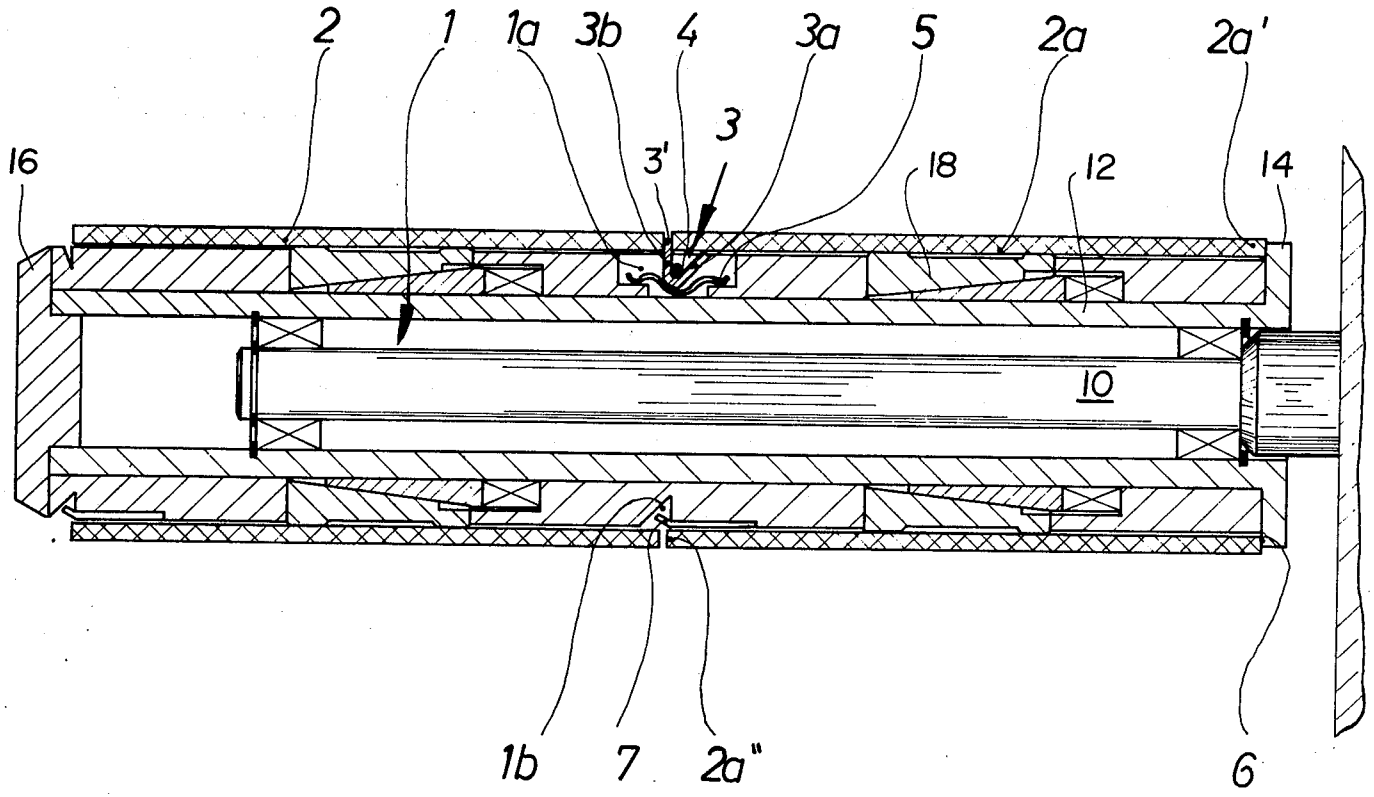
2a'
14
2a
12
5
18
3a
3
4
3'
3b
1a
1
2
16
10
6
2a"
7
1b

SPACER FOR SPOOL TUBES

FIELD AND BACKGROUND OF THE INVENTION

This invention relates in general to the construction of thread-winding devices and, in particular, to a new and useful device for maintaining an axial spacing between spool tubes which are positioned on a common spool carrier, particularly for the spooling of textile threads.

DESCRIPTION OF THE PRIOR ART

Textile threads or threads which comprise chemical fibers must be spooled after their production in order that they can be further treated or processed. For this purpose, it is customary to use relatively large and thick-walled spool tubes of cardboard or multiple coiled papers or similar structures. For reasons of optimal economical utilization of the machine capacity for spooling, several of these tubes are simultaneously inserted on a common spool carrier, one behind the other, and the tubes are centered and clamped.

In order to be able to catch and to secure the thread delivered by the delivering unit, the thread is guided in the known constructions between the contact points of two axially contiguous spool tubes. This presupposes, however, that each tube is provided at the juncture with the adjacent tube with a rounded portion or radius chamfer or a similar structure. Apart from the fact that the additional provision of these rounded portions is expensive, this possibility of spooling finds its natural limit in the thickness of the thread material to be spooled. That is, with this mode of design or procedure, only relatively thin threads can be accommodated between the joints of the two coaxially contiguous spool tubes.

Still another known way of catching and securing the thread assumes that relatively thick-walled spool tubes are used. With such constructions, there are radial slots into which the caught thread must be inserted located near the joints between the spool tubes. It is readily evident that because of their much greater wall thickness and also because of the radial slots to be provided, such tubes are quite expensive and therefore do not qualify as being a cheap disposable spool tube. A condition for the use of such disposable spool tubes, however, is first that they are relatively light and second, they have relatively low wall thicknesses, so as to result in inexpensive spool tubes of relatively small diameters.

SUMMARY OF THE INVENTION

The present invention makes it possible to use a so-called disposable spool tube and provides an improved spool carrier construction which permits mounting of a plurality of such tubes along the length of the spool tube carrier simultaneously. The invention also provides a means for the convenient catching of the thread at the location of means for maintaining a spacing between the spool tubes along the length of the spool carrier. With the present inventive method of catching the thread, the laying on and securing of the thread can take place while dispensing with the radial slots as well as the rounded portions of the tube joints.

The present invention provides a spool carrier which is capable of holding at least two spool tubes of substantially the same diameter which may be slipped over the periphery of the spool carrier and which includes automatic means for maintaining a spacing in an axial direction between the two adjacent spool tubes and it also includes means located on the periphery of the spool carrier for catching the thread to be spooled at the location between the spool tubes.

The means for spacing the spool tubes comprises essentially an angle lever which is pivotal in a recess on the periphery of the spool carrier so that it moves in a direction which is along the axis of the carrier. The lever is generally angled or V-shaped and has two intersecting legs which are flattened at their connecting joint. According to another feature of the invention, the suspension of the angle lever is formed by a pin arranged crosswise to the longitudinal axis and by a spring, such as a leaf spring, which is arranged coaxially with the longitudinal axis.

The means for catching the thread to be spooled comprises, in a further development of the invention, essentially a claw extending coaxially to the longitudinal axis of the spool carrier and arranged in the spool carrier in a V-shaped recess located between the two spool tubes. The claw comprises a sheet bent at a small angle, offset relative to the angle lever by about 90°. The invention is meaningfully perfected and completed by the concept that the means serving to space the spool tubes and to catch the thread are arranged at least approximately form-locking on the circumference of the spool holder.

A number of advantages are achieved by the invention:

The device which serves for the axial spacing of the spool tubes and for the catching of the threads to be spooled is simple in construction and very safe in operation. Because of the small number of required parts, which are simple to manufacture, the apparatus can be manufactured relatively inexpensively. The device readily permits the use of so-called disposable tubes of thin wall thicknesses. The device does not require any edge curvatures or radial slots on the spool tubes for catching and securing the delivered thread or threads. The device may be made very compactly and it is perfectly possible to arrange two or more of the pivot levers and thread-catching claws in or at the spool carrier at many places along its axial length so that a plurality of tubes can be wound with thread material simultaneously if the construction of the spool carriers is correspondingly long.

Accordingly, it is an object of the invention to provide a device for the axial spacing of spool tubes along a common spool carrier which comprises a rotatable cylindrical spool carrier having a periphery with a recess thereon intermediate its length in which is mounted a device which permits the passage of a first tube over the periphery and defines a spacing between this tube and a next adjacent tube, and wherein, the spool carrier also includes means for catching the thread to be spooled which is located between adjacent spool tubes on the spool carrier.

A further object of the invention is to provide a device for axial spacing of spool tubes along the length of a common spool carrier which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

BRIEF DESCRIPTION OF THE DRAWING

The only FIGURE of the drawing is an axial sectional view of a spool carrier accommodating two separate spool tubes, constructed in accordance with the invention.

DESCRIPTION OF THE PREFERRED EMBODIMENT

Referring to the drawing in particular, the invention embodied therein, comprises a spool carrier, generally designated 1, which is mounted for rotation on a supporting shaft 10 and is provided with a tubular body part 12 having an inner out-turned flange 14 which forms an abutment or stop 6 against which a first tube 2*a* is positioned after it is inserted over an unobstructed end 16 of the spool carrier 1. The spool carrier includes the usual wedge-shaped engagement elements 18 for engaging and holding each spool after it has been accurately positioned.

In accordance with the invention, spool tube spacing means, generally designated 3, are accommodated in a recess 1*a* defined at one location around the periphery of the spool carrier 1. The spool carrier means includes an angle member or lever 3 including legs 3*a* and 3*b* which are pivotable about a transversely extending support pin 4. The juncture of the leg portions 3*a* and 3*b* define an exterior curvature which bears against a leaft spring 5 which is mounted in the recess 1*a* between spaced abutments. During insertion of the first spool tube 2*a* onto the periphery of the spool carrier 1, it is moved over the unobstructed end 16, and as it passes along the periphery of the spool carrier, it deflects leg 3*a* so as to rotate it clockwise and to move it into recess 1*a* and to cause the opposite leg 3*b* to move out of the recess after the end of the first spool tube 2*a* passes therebeyond and its forward edge 2*a'* abuts against the stop 6. The upturned leg 3*b* then forms a stop for the second spool tube which is inserted over the unobstructed end 16 until it contacts the upstanding leg portion 3*b* of the angle lever. The thickness of the legs 3*a* and 3*b* of the angle lever of the spool tube spacing means 3 is adaptable to the respective conditions of thickness of the thread material and also to the requirement for a spacing between the tubes which will accommodate a thread-catching device.

In accordance with another aspect of the invention, thread-catching means 7 are located in a slot 1*b* diametrically opposite the slot 1*a* on the periphery of the carrier spool 1.

After completion of the spooling of the thread material onto the tube 2, the second tube is pulled off the spool carrier 1 in the usual manner off the unobstructed end 16. The end 2*a''* moves away from the leg 3*b* and the leaf spring 5 flips the spacer means 3 to the left and thus clears the way for the spool tube 2*a* to be pulled off the spool carrier 1. The leg 3*b*, in the meantime, moves into recess 1*a*.

The thread-catching means comprises a claw 7 which is located in the recess 1*b* at 90° from the recess 1*a*. It comprises a sheet which is bent at a small angle and arranged coaxially with the longitudinal axis of the spool carrier 1. The recess 1*b*, as seen in the sectional view, is substantially V-shaped. Both the spacer means 3 and the thread-catching means are accommodated within the periphery of the carrier spool 1.

In the embodiment shown, the spool carrier accommodates only two tubes but, of course, a number much greater than the two may be accommodated by providing several of the tube spacing elements 3 and thread-catching elements 7 along the length of the carrier.

While a specific embodiment of the invention has been shown and described in detail to illustrate the application of the principles of the invention, it will be understood that the invention may be embodied otherwise without departing from such principles.

What is claimed is:

1. A device for the axial spacing of spool tubes along a common spool carrier, comprising a rotatable cylindrical spool carrier having a periphery with a recess therein intermediate the length of said spool and having an unobstructed end and an opposite end with a projecting stop, first and second spool tubes of substantially the same length and internal diameter being engageable onto the unobstructed end and over the periphery of said spool carrier with the first spool abutting against said stop and with the two tubes being arrangeable in end-to-end relationship on said spool carrier, spool tube spacing means located in the recess on the periphery of said spool carrier and being movable by engagement of said first spool as it is moved over the periphery of said spool carrier to abut against said top to prevent movement of said second spool into abutting engagement with said first spool and effectively spacing said second tube axially away from said first tube, and thread-catching means on said spool located between said spool tubes for catching the thread to be spooled, said spool tube spacing means comprising an angle lever pivotally mounted in said recess for movement in an axial direction, said angle lever being of a V-shape configuration and including first and second interconnected leg portions which are flattened at their connections.

2. A device for the axial spacing of spool tubes along a common spool carrier, comprising a rotatable cylindrical spool carrier having a periphery with a recess therein intermediate the length of said spool and having an unobstructed end and an opposite end with a projecting stop, first and second spool tubes of substantially the same length and internal diameter being engageable onto the unobstructed and and over the periphery of said spool carrier with the first spool abutting against said stop and with the two tubes being arrangeable in end-to-end relationship on said spool carrier, spool tube spacing means located in the recess on the periphery of said spool carrier and being moveable by engagement of said first spool as it is moved over the periphery of said spool carrier to abut against said stop to prevent movement of said second spool into abutting engagement with said first spool and effectively spacing said second tube axially away from said first tube, and thread-catching means on said spool located between said spool tubes for catching the thread to be spooled, said spool tube spacing means comprising an angle lever pivotally mounted in said recess for movement in an axial direction, said angle lever being pivotally engaged with one side of said pin, a spring engaging the opposite side of said angle lever extending in an axial direction.

3. A device for the axial spacing of spool tubes along a common spool carrier, comprising a rotatable cylindrical spool carrier having a periphery with a recess therein intermediate the length of said spool and having an unobstructed end and an opposite end with a projecting stop, first and second spool tubes of substantially the same length and internal diameter being engageable onto the unobstructed end and over the periphery of said spool carrier with the first spool abutting against said stop and with the two tubes being arrangeable in end-to-end relationship on said spool carrier, spool tube spacing means located in the recess on the periphery of said spool carrier and being movable by engagement of said first spool as it is moved over the periphery of said spool carrier to abut against said stop to prevent movement of said second spool into abutting engagement with said first spool and effectively spacing said second tube axially away from said first tube, and thread-catching means on said spool located between said spool tubes for catching the thread to be spooled, said thread-catching means comprising a claw extending in an axial direction, said spool carrier including a second recess circumferentially spaced from the recess on said carrier spool.

4. A device according to claim 3, wherein said claw comprises a sheet which is bent at a small angle.

5. A device according to claim 4, wherein said claw is offset about 90° relative to said spool tube spacing means on said spool carrier.

6. A device for the axial spacing of spool tubes along a common spool carrier, comprising a rotatable cylindrical spool carrier having a periphery with a recess therein intermediate the length of said spool and having an unobstructed end and an opposite end with a projecting stop, first and second spool tubes of substantially the same length and internal diameter being engageable onto the onobstructed end and over the periphery of said spool carrier with the first pool abutting against said stop and with the two tubes being arrangeable in end-to-end relationship on said spool carrier, spool tube spacing means located in the recess on the periphery of said spool carrier and being movable by engagement of said first spool as it is moved over the periphery of said spool carrier to abut against said stop to prevent movement of said second spool into abutting engagement with said first spool and effectively spacing said second tube axially away from said first tube, and thread-catching means on said spool located between said spool tubes for catching the thread to be spooled, said spool carrier has a second recess spaced 90° from the recess for said spool tube spacing means, said thread-catching means being located in said recess below the periphery of said carrier spool.

* * * * *